US007401708B2

(12) United States Patent
Lin

(10) Patent No.: US 7,401,708 B2
(45) Date of Patent: Jul. 22, 2008

(54) WASTE CONTAINER WITH REMOVABLE INNER CONTAINER

(76) Inventor: Tsong-Yow Lin, No. 57-1, Yung Ho Street, Yung Ho Village, Taichung Hsien, Ta Tu Hsiang (TW)

( * ) Notice: Subject to any disclaimer, the term of this patent is extended or adjusted under 35 U.S.C. 154(b) by 548 days.

(21) Appl. No.: 10/906,727

(22) Filed: Mar. 3, 2005

(65) Prior Publication Data

US 2006/0196873 A1 Sep. 7, 2006

(51) Int. Cl.
*B65F 1/08* (2006.01)

(52) U.S. Cl. ..... 220/23.87; 220/908.1; 220/756; 220/495.08; 220/495.1

(58) Field of Classification Search ..... None
See application file for complete search history.

(56) References Cited

U.S. PATENT DOCUMENTS 2,068,647 A * 1/1937 Hohmann ..... 220/17.1
2,533,524 A * 12/1950 Snider ..... 220/494
3,050,209 A * 8/1962 Germaine et al. ..... 220/484
3,176,873 A * 4/1965 Montgomery ..... 220/765
3,904,439 A * 9/1975 Barrett, Jr. ..... 429/99
5,287,990 A * 2/1994 Knox ..... 220/760

* cited by examiner

*Primary Examiner*—Stephen J. Castellano
(74) *Attorney, Agent, or Firm*—Alan Kamrath; Kamrath & Associates PA

(57) ABSTRACT

A waste container includes an outer container and an inner container removably mounted in the outer container. The inner container includes a body and two handles. The body of the inner container includes a peripheral wall delimiting an opening. The peripheral wall includes two engaging sections on two opposite portions thereof. Each handle includes two ends pivotally coupled to the engaging sections respectively. Each handle is pivotable to an upward position allowing carriage of the inner container. Each handle is pivotable to a resting position for retaining a peripheral edge of a bag mounted in the inner container.

20 Claims, 10 Drawing Sheets

WASTE CONTAINER WITH REMOVABLE INNER CONTAINER

FIELD OF THE INVENTION

The present invention relates to a waste container. In particular, the present invention relates to a waste container that includes a removable inner container.

BACKGROUND OF THE INVENTION

FIGS. 1 and 2 of the drawings illustrates a conventional waste container comprising an outer container 5, a cover 6, and an inner container 1 mounted in the outer container 5. The inner container 1 includes a peripheral wall 3 and a peripheral end edge 2 that delimits an upper opening. In use, a plastic bag 4 is usually placed in the inner container 1, with a peripheral edge of the plastic bag 4 extending outward across the peripheral end edge 2 and then downward. The exposed peripheral edge of the plastic bag 4 fails to provide an aesthetically pleasing effect. When the plastic bag 4 is full of waste (including garbage or the like) that is too heavy for the plastic bag 4 to withstand, the plastic bag 4 is liable to break while it is lifted, leading to contamination of the inner container 1. To solve this problem, the inner container 1 is carried to a desired location, and the plastic bag 4 is then packed and discarded. To move the inner container 1 with heavy waste, the user has to hold the inner container 1 at two sides of the peripheral end edge of the inner container 1 with both hands. Hence, the user walks with difficulty and might get hurt while carrying the inner container 1 containing heavy waste.

SUMMARY OF THE INVENTION

A waste container in accordance with the present invention comprises an outer container and an inner container removably mounted in the outer container. The inner container comprises a body and two handles. The body of the inner container includes a peripheral wall delimiting an opening. The peripheral wall includes two engaging sections on two opposite portions thereof. Each handle includes two ends pivotally coupled to the engaging sections respectively.

Each handle is pivotable to an upward position allowing carriage of the inner container. Further, each handle is pivotable to a resting position for retaining a peripheral edge of a bag mounted in the inner container.

Preferably, wherein the engaging sections are formed on an upper end of the peripheral wall.

Preferably, each handle has a curvature corresponding to an associated portion of the inner periphery of the peripheral wall.

In an embodiment of the invention, each engaging section includes an elongated projection extending in a direction parallel to a longitudinal direction of the peripheral wall.

The inner waste container further includes two coupling members respectively mounted to the engaging sections. Each coupling member includes a longitudinal groove allowing the coupling member to slide along an associated one of the engaging sections until an end wall delimiting the longitudinal groove of the coupling member comes into contact with a top end of the associated engaging section.

Preferably, each engaging section includes a transverse hole extending through the peripheral wall. Preferably, each coupling member includes a transverse hole aligned with the transverse hole of the associated engaging section. The waste container further includes two fasteners and two nuts. Each fastener extends through the transverse hole of an associated one of the engaging sections and the transverse hole of an associated one of the coupling members and then engaged with an associated one of the nuts, thereby fixing the coupling member to the associated engaging section.

Preferably, each coupling member includes two pivotal holes to which the ends of the handles are pivotally coupled.

Preferably, the transverse hole of each coupling member includes a stepped portion for accommodating a portion of the associated nut.

Preferably, each longitudinal groove is defined in a side of the associated coupling member.

Preferably, the stepped portion and the longitudinal groove are located on two opposite sides of the coupling member.

Preferably, the body of the inner container includes a peripheral end edge adjacent to the engaging sections.

In another embodiment of the invention, each engaging section is integrally formed on the inner periphery of the peripheral wall.

Preferably, each engaging section includes two pivotal holes to which the ends of the handles are pivotally coupled.

Other objectives, advantages, and novel features of the invention will become more apparent from the following detailed description when taken in conjunction with the accompanying drawings.

DETAILED DESCRIPTION OF THE PREFERRED EMBODIMENTS

Figure 1:
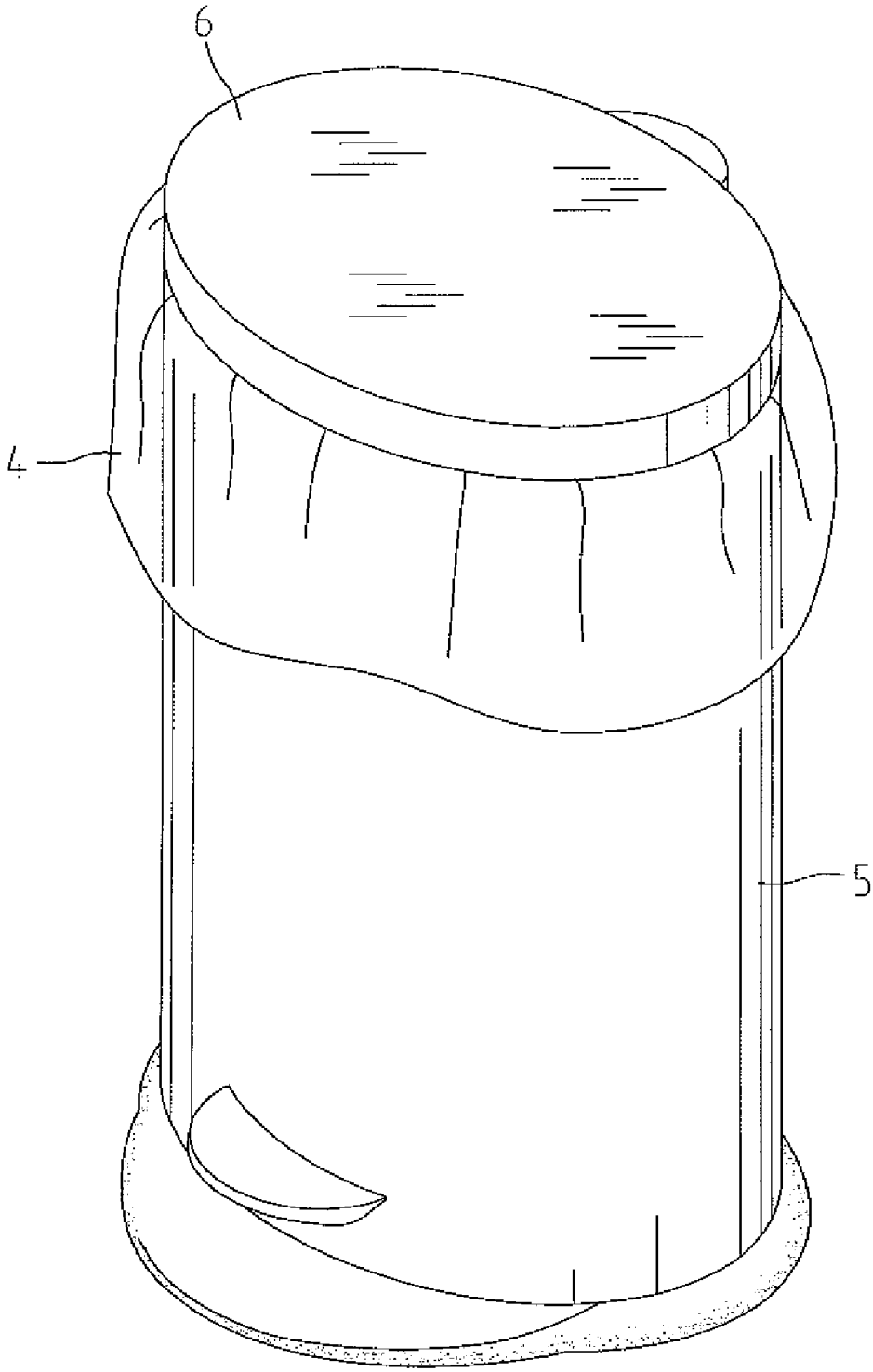
Fig.1 PRIOR ART
FIG. 1 is a perspective view of a conventional waste container.
Figure 2:
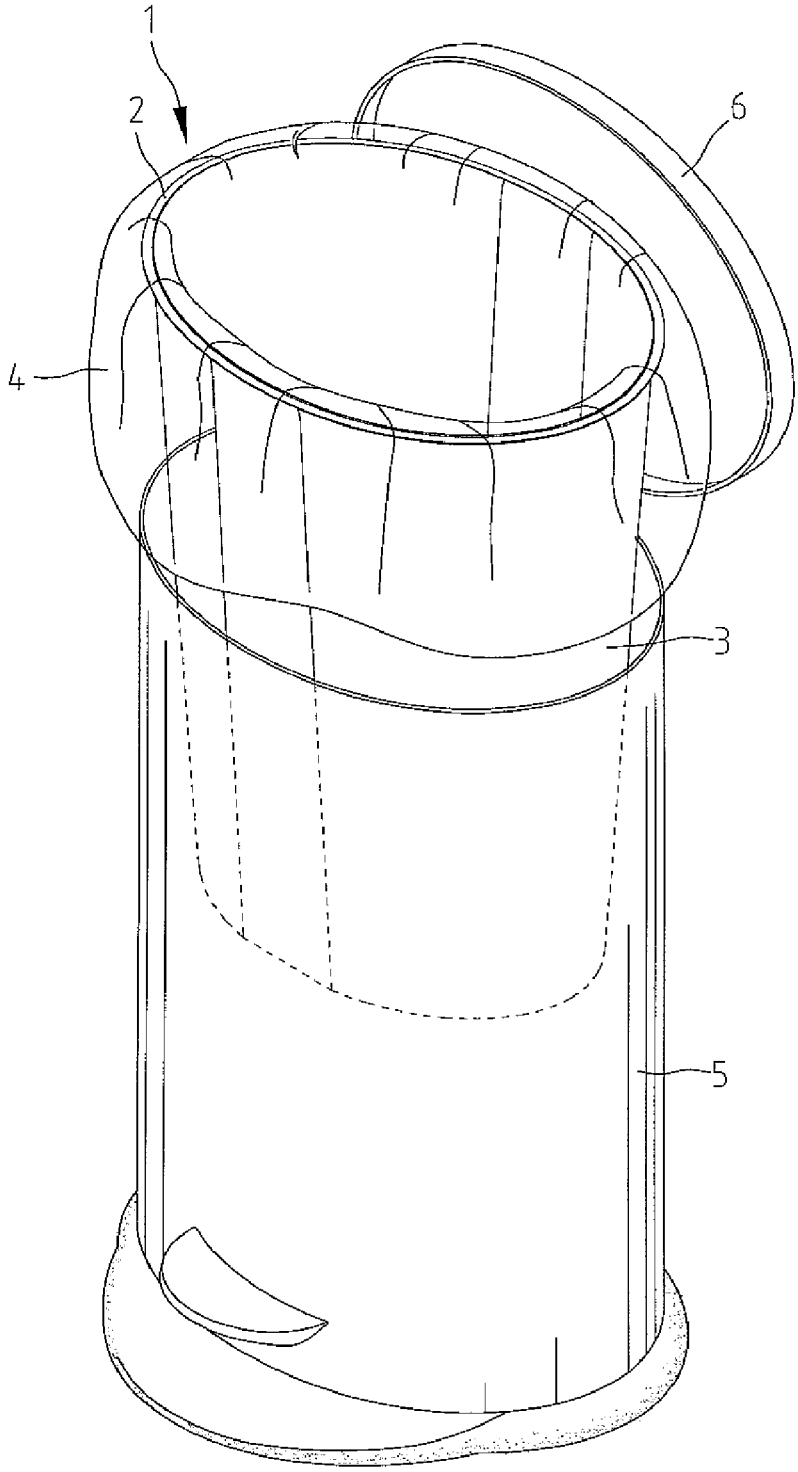
Fig.2 PRIOR ART
FIG. 2 is a perspective view of the conventional waste container, wherein the cover of the waste container is opened.
Figure 3:
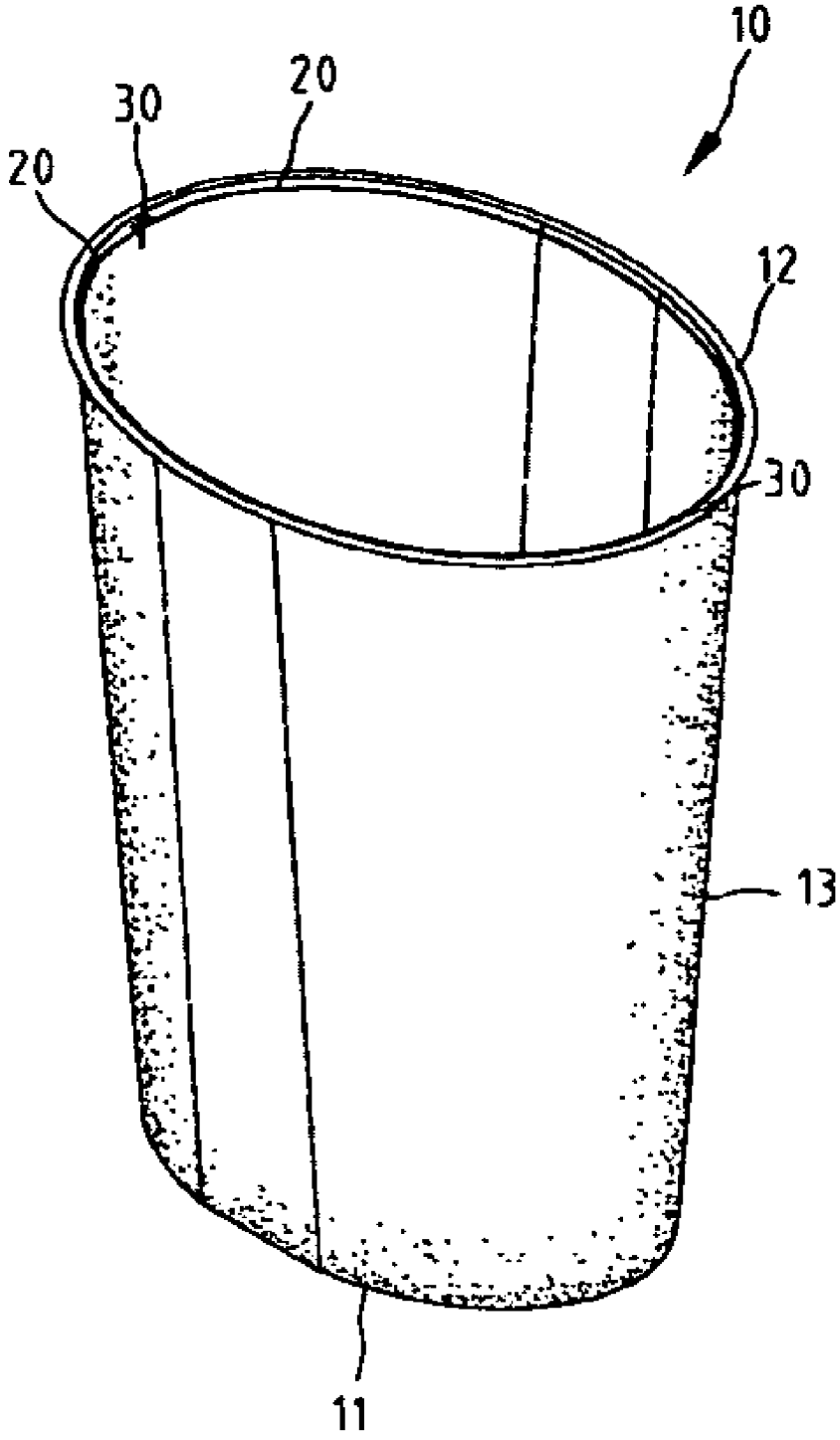
FIG. 3 is a perspective view of an embodiment of an inner container for a waste container in accordance with the present invention.

Referring to FIG. 3, an embodiment of an inner container for a waste container in accordance with the present invention comprises a body 10, two handles 20, and two coupling members 30. The body 10 includes a bottom 11 and a peripheral wall 13 that defines an opening (not labeled). The body 10 may further include a peripheral end edge 12.

Figure 4:
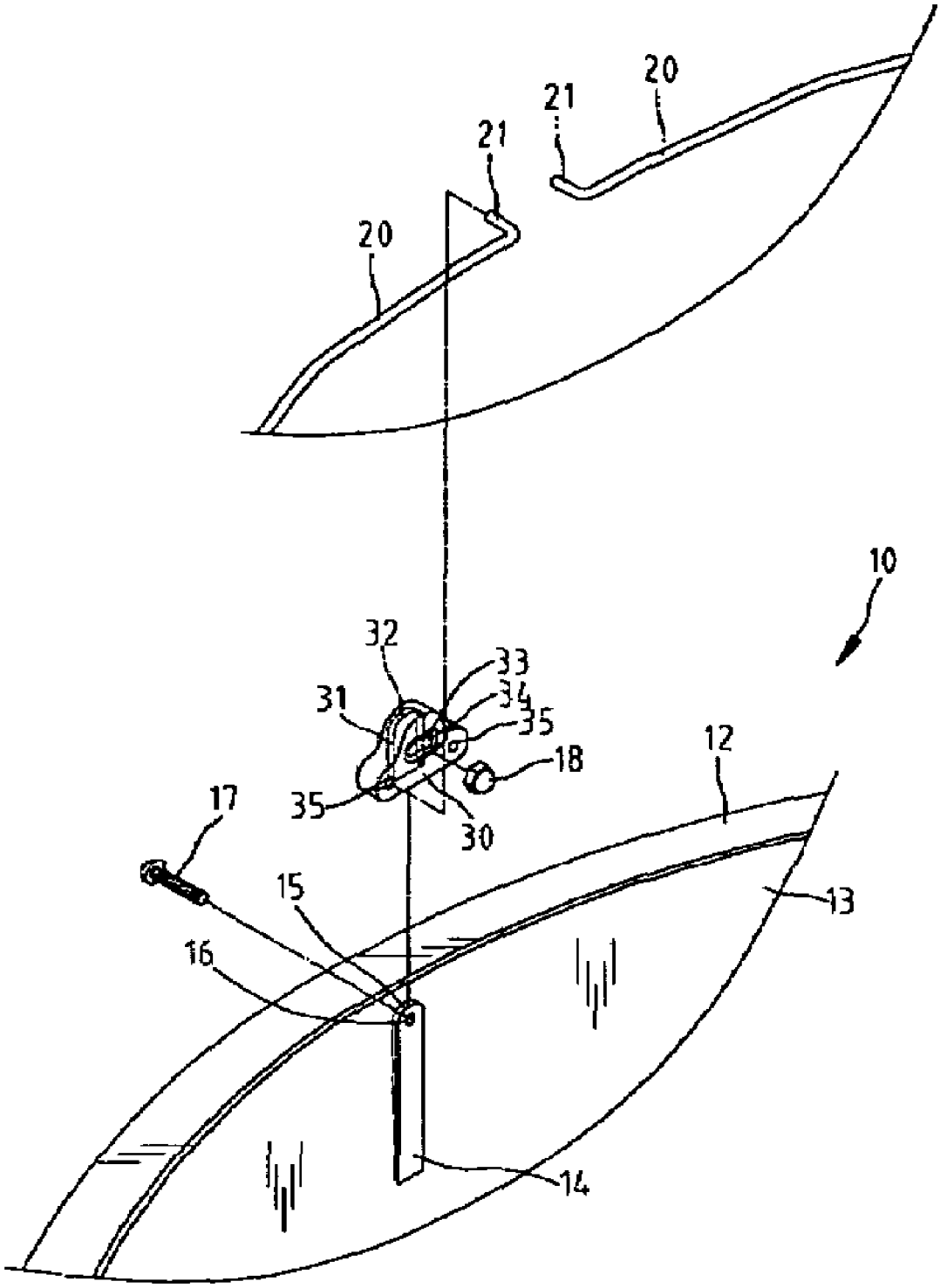
FIG. 4 is an enlarged exploded perspective view showing a pivotal arrangement for two handles of the inner container in accordance with the present invention.
Figure 5:
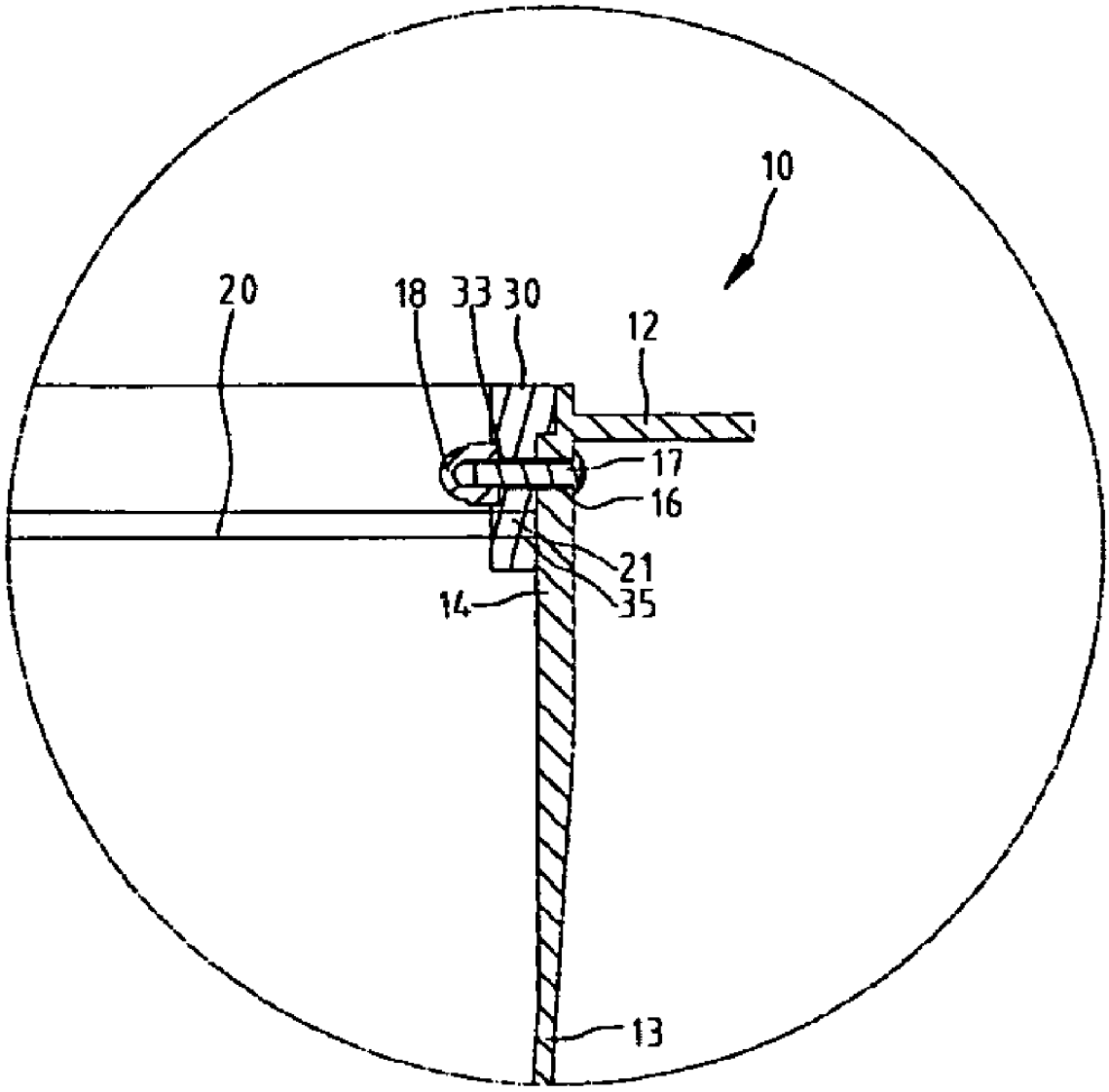
FIG. 5 is an enlarged sectional view of the pivotal arrangement of the inner container in accordance with the present invention.

Referring to FIGS. 4 and 5, the peripheral wall 13 includes two opposite engaging sections 14 on an upper end of an inner periphery thereof. In the illustrated embodiment, each engaging portion 14 is an elongated projection extending in a direction parallel to a longitudinal direction of the peripheral wall 13. Each engaging portion 14 includes a transverse hole 16 extending through the peripheral wall 13.

Each coupling member 30 is mounted to an associated engaging section 14. In the illustrated embodiment, the coupling member 30 includes a longitudinal groove 31 in a side thereof, allowing the coupling member 30 to slide along the associated engaging portion 14 until an end wall 32 delimiting the longitudinal groove 31 comes in contact with a top end 15 of the associated engaging portion 14. The coupling member 30 further includes a transverse hole 33 extending along a direction transverse to the longitudinal direction of the longitudinal groove 31. The transverse hole 33 of the coupling member 30 is aligned with the transverse hole 16 of the associated engaging portion 14 when the end wall 32 delimiting the longitudinal groove 31 of the coupling member 30 comes in contact with the top end 15 of the associated engaging portion 14. A fastener 17 (such as a screw) is extended through the transverse hole 16 of the engaging portion 14 and the transverse hole 33 of the coupling member 30 and then coupled with a nut 18. Thus, the coupling member 30 is fixed to the associated engaging portion 14. Preferably, the transverse hole 33 of each coupling member 30 includes a stepped portion 34 for accommodating a portion of the associated nut 118. Preferably, the stepped portion 34 on each coupling member 30 is opposite to the longitudinal groove 31. Namely, the stepped portion 34 and the longitudinal groove 31 are respectively located on two opposite sides of the coupling member 30.

Each coupling member 30 further includes two pivotal holes 35. Still referring to FIGS. 4 and 5, an end of each handle 20 is pivotally received in an associated pivotal hole 35 of an associated coupling member 30. The handles 20 are normally in contact with the inner periphery of the peripheral wall 13 under the action of gravity. Preferably, each handle 20 has a curvature corresponding to an associated portion of the inner periphery of the peripheral wall 13.

Figure 6:
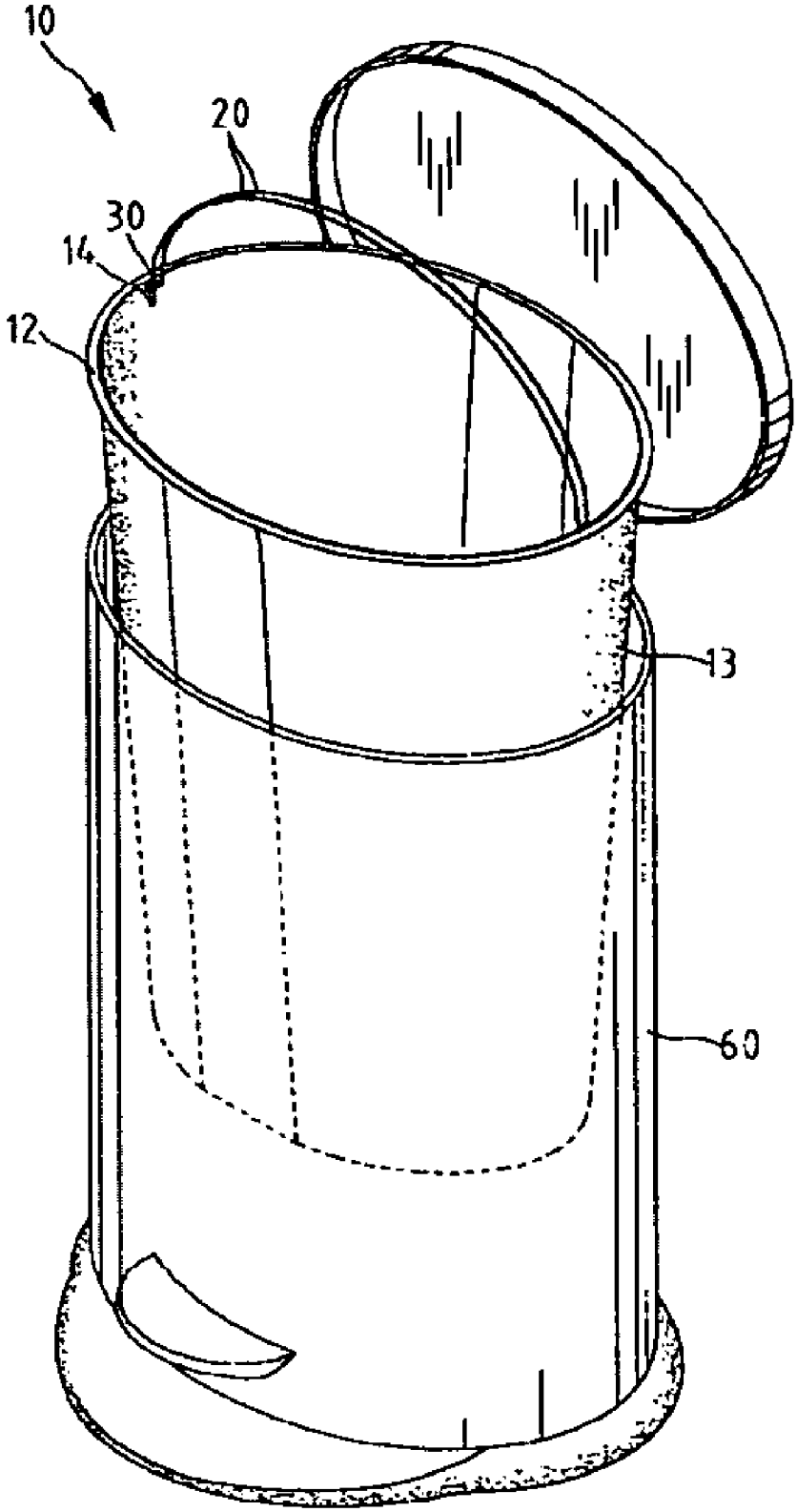
FIG. 6 is a perspective view illustrating removal of the inner container from an outer container of the waste container in accordance with the present invention.

Referring to FIG. 6, the inner container can be mounted into an outer container 60 of a waste container. A user may hold the handles 20 and thus easily remove the inner container from the outer container 60.

Figure 7:
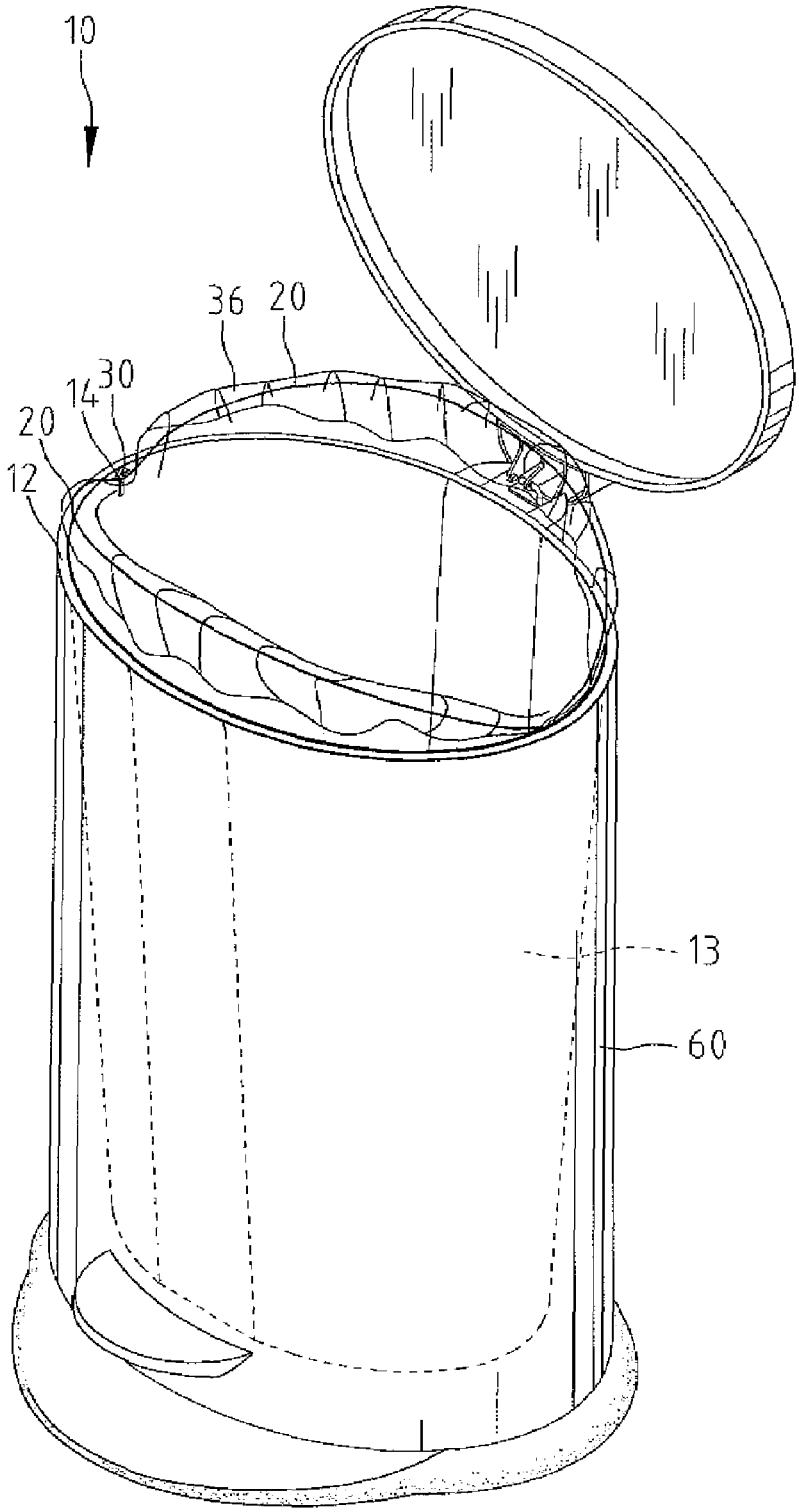
FIG. 7 is a perspective view illustrating mounting of a plastic bag into the waste container in accordance with the present invention.
Figure 8:
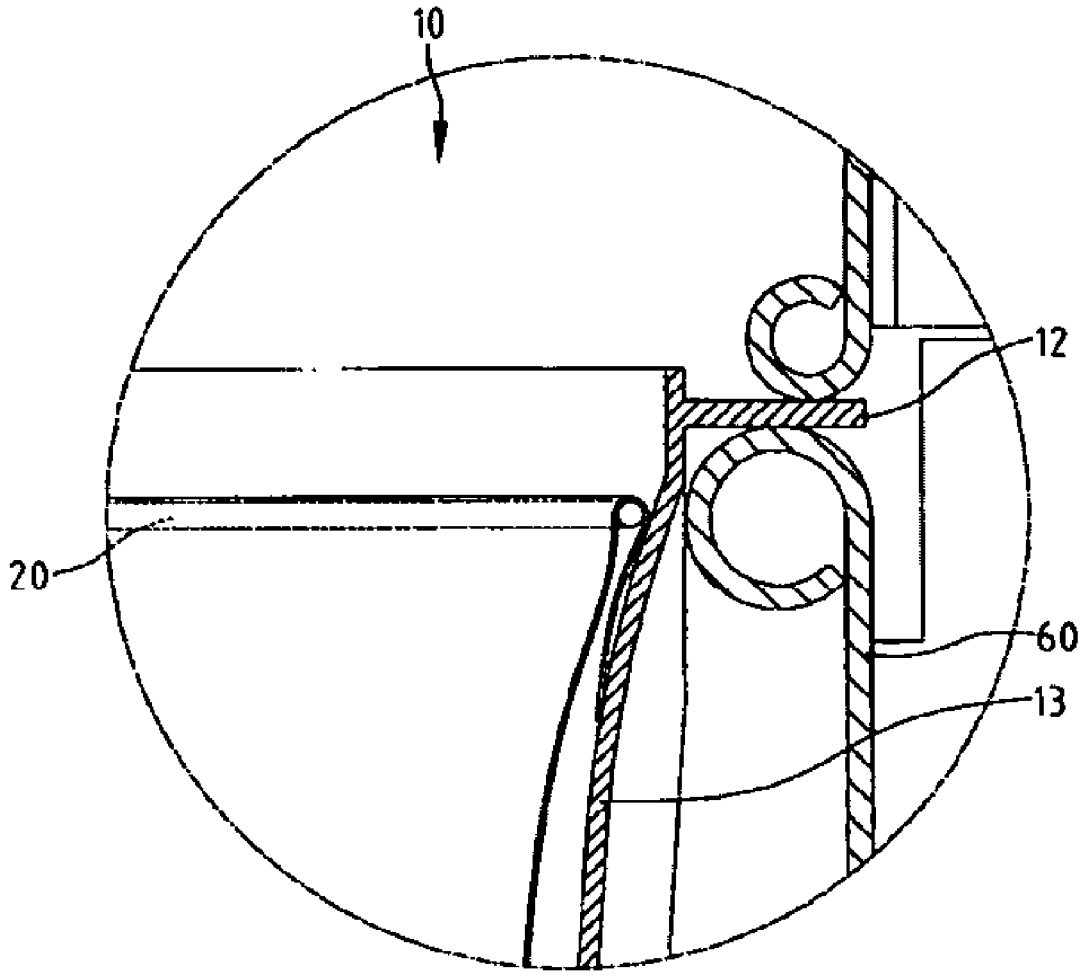
FIG. 8 is an enlarged sectional view illustrating retaining of the plastic bag.

Referring to FIGS. 7 and 8, when placing a plastic bag 36 into the inner container, the handles 20 are slightly pivoted upward, and the peripheral edge of the plastic bag 36 is extended across the handles 20 and then bent around. The handles 20 are then released and thus pivot downward under the action of gravity. The peripheral edge of the plastic bag 36 is thus retained to the inner container by the handles 20 that come in contact with the peripheral wall 13 of the body 10 of the inner container. An aesthetically pleasing effect is provided, as the plastic bag 36 is not exposed. Removal of the plastic bag 36 can be easily achieved by pivoting the handles 20 upward.

Figure 9:
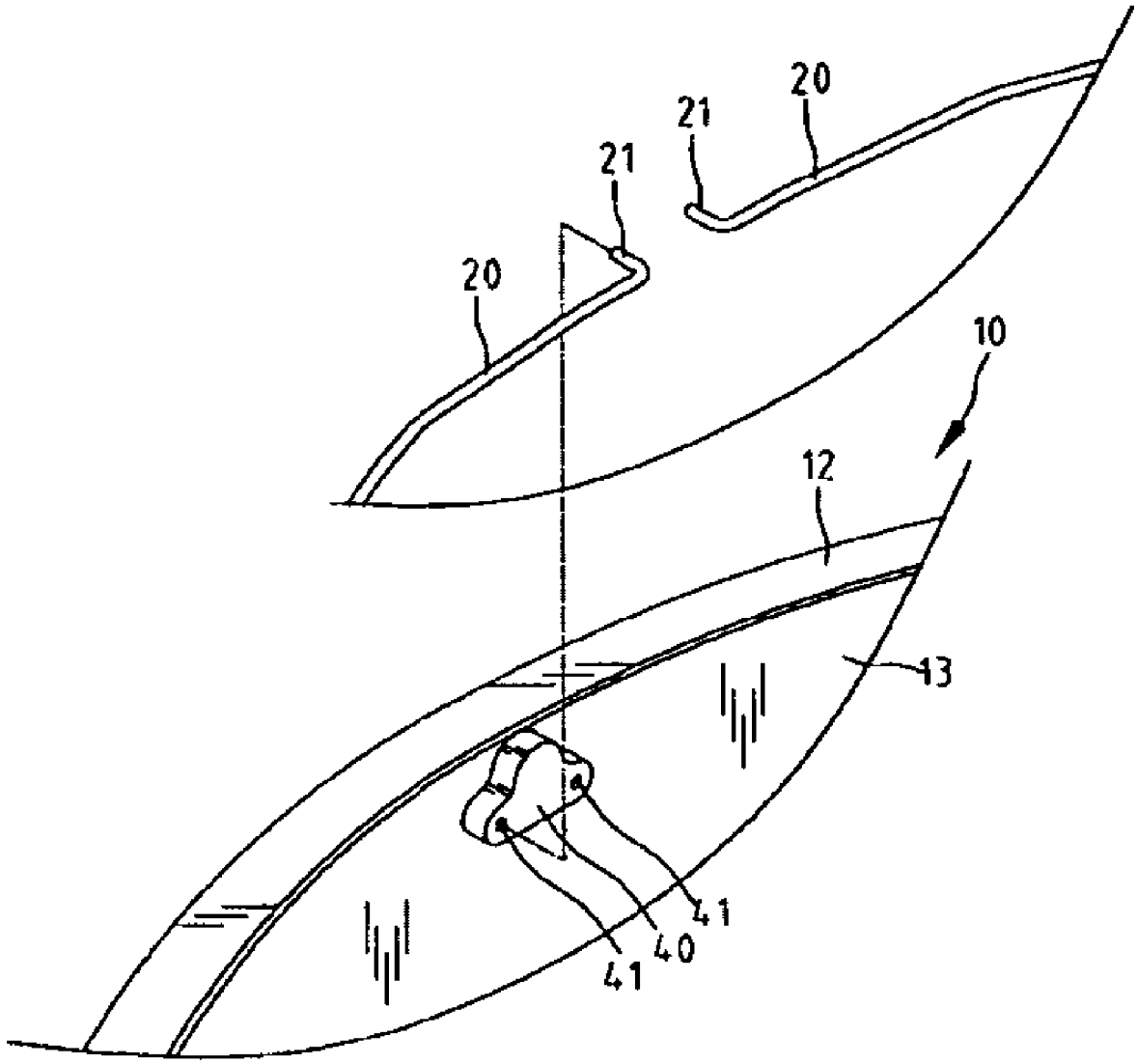
FIG. 9 is an enlarged perspective view illustrating another pivotal arrangement of the waste container in accordance with the present invention.
Figure 10:
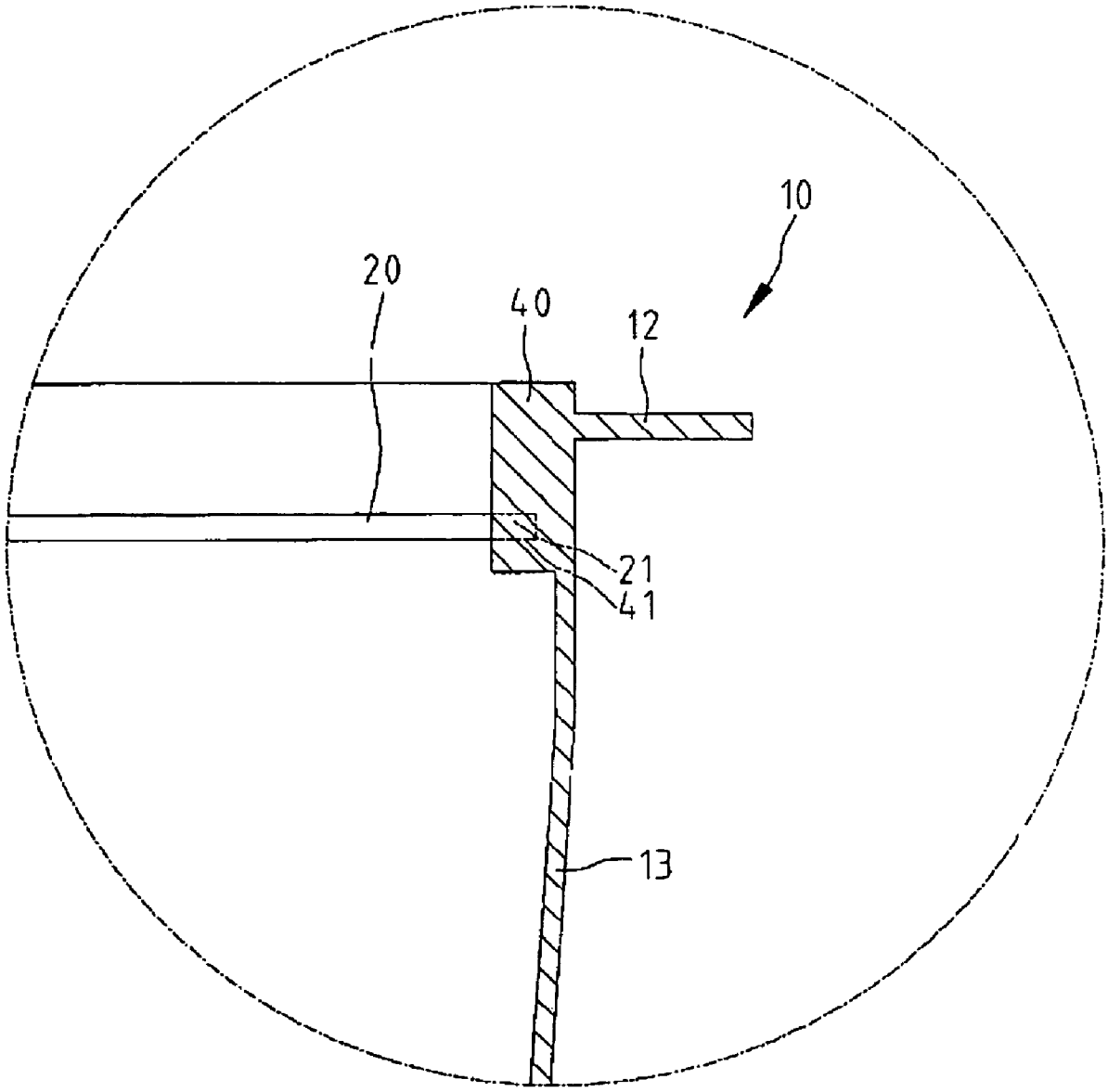
FIG. 10 is an enlarged sectional view of the pivotal arrangement in FIG. 9.

FIGS. 9 and 10 illustrate another arrangement of the pivotal arrangement of the inner container in accordance with the present invention. In this embodiment, two engaging sections 40 are respectively provided on two opposite portions of the upper end of the inner periphery of the peripheral wall 13. Each engaging section 40 includes two pivotal holes 41 for respectively and pivotally engaging with the ends 21 of the handles 20. Preferably, each engaging section 40 is integrally formed with the peripheral wall 13. Assembly of the handles 20 is simplified while providing the engaging sections 40 with improved strength.

Although specific embodiments have been illustrated and described, numerous modifications and variations are still possible without departing from the essence of the invention. The scope of the invention is limited by the accompanying claims.

What is claimed is:

1. A waste container comprising:

an outer container; and an inner container removably mounted in the outer container, with the inner container comprising: a body and first and second handles, with the body of the inner container including a peripheral wall having an inner periphery delimiting an opening, with the peripheral wall including first and second engaging sections on first and second opposite portions of the inner periphery of the peripheral wall respectively, with the first and second handles each having first and second ends pivotally coupled to the first and second engaging sections respectively, with the first and second handles each further having an intermediate portion between the first and second ends, wherein the intermediate portion of each of the first and second handles has a curvature corresponding to an associated portion of the inner periphery of the peripheral wall, with the first and second handles being pivotable to an upward position allowing carriage of the inner container, with each of the first and second handles being pivotable to a resting position, wherein the first and second handles extend in opposite directions from each other when in the resting position, wherein the intermediate portions of the first and second handles engage the associated portion of the inner periphery of the peripheral wall when the first and second handles are in the resting position to clamp a peripheral edge of a bag against the inner periphery of the peripheral wall when the first and second handles are in the resting position.

2. The waste container as claimed in claim 1, wherein the first and second engaging sections are formed on an upper end of the peripheral wall.

3. The waste container as claimed in claim 1, wherein each of the first and second engaging sections includes an elongated projection extending in a direction parallel to a longitudinal direction of the peripheral wall.

4. The waste container as claimed in claim 3, wherein the inner container further includes first and second coupling members respectively mounted to the first and second engaging sections, each of the first and second coupling members including a longitudinal groove allowing each of the first and second coupling members to slide along an associated one of the first and second engaging sections until an end wall delimiting the longitudinal groove of the one of the first and second coupling members comes into contact with a top end of the associated one of the first and second engaging sections.

5. The waste container as claimed in claim 1, wherein each of the first and second engaging sections includes a transverse hole extending through the peripheral wall, the inner container further including first and second coupling members respectively mounted to the first and second engaging sections, each of the first and second coupling members including a transverse hole aligned with the transverse hole of the associated one of the first and second engaging sections, with the inner container further including two fasteners and two nuts, each of the two fasteners extending through the transverse hole of an associated one of the first and second engaging sections and the transverse hole of an associated one of the first and second coupling members and to engage with an associated one of the two nuts, and fixing the associated one of the first and second coupling members to the associated one of the first and second engaging sections.

6. The waste container as claimed in claim 5, wherein each of the first and second coupling members includes two pivotal holes, wherein the first and second ends of the first and second handles are pivotally coupled to an associated one of the two pivotal holes.

7. The waste container as claimed in claim 5, wherein the transverse hole of each of the first and second coupling members includes a stepped portion for accommodating a portion of the associated one of the two nuts.

8. The waste container as claimed in claim 5, wherein the longitudinal groove of each of the first and second coupling members is defined in a side of the associated one of the first and second coupling members.

9. The waste container as claimed in claim 8, wherein the transverse hole of each of the first and second coupling members includes a stepped portion for accommodating a portion of the associated one of the two nuts, and wherein the stepped portion and the longitudinal groove of each of the first and second coupling members are located on two opposite sides of the one of the first and second coupling members.

10. The waste container as claimed in claim 1, wherein the body of the inner container includes a peripheral end edge adjacent to the first and second engaging sections, with the peripheral end edge delimiting the opening.

11. The waste container as claimed in claim 1, wherein each of the first and second engaging sections is integrally formed on the inner periphery of the peripheral wall.

12. The waste container as claimed in claim 11, wherein each of the first and second engaging sections includes two pivotal holes, wherein the first and second ends of the first and second handles are each pivotally coupled to one of the two pivotal holes.

13. The waste container as claimed in claim 1, wherein the inner periphery of the peripheral wall has a peripheral wall radius, with the intermediate portions of the first and second handles each having an intermediate portion radius, with the intermediate portion radius being generally equal to the peripheral wall radius.

14. The waste container as claimed in claim 13, wherein the intermediate portions of the first and second handles engage the inner periphery of the peripheral wall at points where the peripheral wall delimits the opening.

15. The waste container as claimed in claim 1, wherein the opening has a first portion symmetrical to a second portion, wherein the first handle has a shape corresponding to the first portion of the opening and the second handle has a shape corresponding to the second portion of the opening, with the first and second handles being of identical shape and size.

16. The waste container as claimed in claim 15, wherein the first and second portions of the opening each has a continuous arcuate shape, wherein the intermediate portions of the first and second handles abut in their entirety respectively the continuous arcuate shapes of the first and second portions of the opening.

17. The waste container as claimed in claim 1, wherein the first and second handles are contained in their entirety in the inner container when the first and second handles are in the resting position.

18. The waste container as claimed in claim 1, wherein the intermediate portions of the first and second handles are spaced from the peripheral wall and extend parallel to each other when the first and second handles are in the upward position.

19. The waste container as claimed in claim 18, wherein the intermediate portions of the first and second handles abut each other when the first and second handles are in the upward position.

20. A waste container comprising:

an outer container;

an inner container removably mounted in the outer container, with the inner container comprising: a body and first and second handles, with the body of the inner container including a peripheral wall having an inner periphery delimiting an opening, with the peripheral wall including first and second engaging sections on first and second opposite portions of the inner periphery of the peripheral wall respectively, with the first and second handles each having first and second ends pivotally coupled to the first and second engaging sections respectively, wherein the first engaging section removably receives the first end of the first and second handles, with the first and second handles each further having an intermediate portion between the first and second ends, wherein the intermediate portion of each of the first and second handles has a curvature corresponding to an associated portion of the inner periphery of the peripheral wall, with the first and second handles being pivotable to an upward position allowing carriage of the inner container, with each of the first and second handles being pivotable to a resting position, wherein the first and second handles extend in opposite directions from each other when in the resting position, wherein the intermediate portions of the first and second handles engage the associated portion of the inner periphery of the peripheral wall when the first and second handles are in the resting position; and a bag having a peripheral edge, with the bag being removeably mounted in the inner periphery of the inner container, wherein the peripheral edge of the bag is clamped against the inner periphery of the peripheral wall by the intermediate portions of the first and second handles when the first and second handles are in the resting position.

* * * * *